US009339827B2

(12) United States Patent
Chan

(10) Patent No.: US 9,339,827 B2
(45) Date of Patent: May 17, 2016

(54) PORTABLE MISTING FAN

(71) Applicant: Perfect Union Co., Ltd., New Taipei (TW)

(72) Inventor: Ching Chan, New Taipei (TW)

(73) Assignee: PERFECT UNION CO., LTD., New Taipei (TW)

( * ) Notice: Subject to any disclaimer, the term of this patent is extended or adjusted under 35 U.S.C. 154(b) by 94 days.

(21) Appl. No.: 14/330,646

(22) Filed: Jul. 14, 2014

(65) Prior Publication Data

US 2016/0008827 A1 Jan. 14, 2016

(51) Int. Cl.
*B05B 3/02* (2006.01)
*B01F 3/04* (2006.01)

(52) U.S. Cl.
CPC ..... *B05B 3/022* (2013.01); *B01F 3/04056* (2013.01); *B05B 3/02* (2013.01)

(58) Field of Classification Search
CPC .... B01F 3/04; B01F 3/04007; B01F 3/04021; B01F 3/04049; B01F 3/04056; B05B 3/02; B05B 3/022
USPC ..... 261/28.2, 30, 34.1, 37, 72.1; 239/215, 239/289
See application file for complete search history.

(56) References Cited

U.S. PATENT DOCUMENTS 7,143,958 B1 * 12/2006 Dorney ..... B05B 3/022 215/229
8,016,270 B2 * 9/2011 Chen ..... F24F 5/0035 261/28

* cited by examiner

*Primary Examiner* — Robert A Hopkins
(74) *Attorney, Agent, or Firm* — Jackson IPG PLLC; Demian K. Jackson

(57) ABSTRACT

A portable misting fan is provided with a housing; a fluid reservoir including an externally threaded neck; an internally threaded connecting ring secured to the neck; a battery powered fan motor in the housing; fan blades; a first switch on the housing for turning on or off the fan motor; a battery powered pump motor in the housing; a pump driven by the pump motor; a fluid outlet port on the pump; a hose having one end secured to the fluid outlet port; an atomizing head on the housing and secured to the other end of the hose; a fluid inlet tube; a second switch on the housing for turning on or off the pump motor; and a fluid tube having one end secured to the fluid inlet tube and an other end terminates in the fluid reservoir. Fin mist can be generated by the misting fan.

1 Claim, 4 Drawing Sheets

PORTABLE MISTING FAN

BACKGROUND OF THE INVENTION

1. Field of the Invention

The invention relates to portable fans and more particularly to a portable misting fan with improved characteristics.

2. Description of Related Art

It is known that a fine mist of a liquid can cool surrounding air by evaporation. Cooling occurs when mist droplets impinge on a target and are evaporated into the surrounding air. Additional cooling takes place if the liquid is very cold relative to the surrounding air and if an air stream blows on a user so as to accelerate the evaporation of water from the skin and clothing.

U.S. Pat. No. 6,398,132 to Junkel et al. discloses a p portable spray misting device including a hollow body capable of holding a volume of fluid to be dispensed. The body includes a flattened base capable of supporting the body upon a flat surface and a contoured upper body terminating in an upwardly extending and interiorly open neck which defines a first port having a first diameter. A spray application head for issuing a mist spray of the fluid is secured to the open neck by an integrally formed collar. An interiorly open and annular rim extends from a specified location of the contoured upper body and defines a second port with a diameter greater than the first diameter of the first port. A cap is provided for securing in a fluid-tight manner over the annular rim of the second collar so as to provide a device which permits a user to more quickly refill a fluid reservoir in the body.

The above patent suffers from the following disadvantage: Fine mist can be obtained only when there is sufficient fluid in the body. Thus, it works well initially. However, fine mist cannot be obtained as the fluid decreases. A frequent refilling of the fluid is required. This is very inconvenient. Thus, the need for improvement still exists.

Notwithstanding the prior art, the invention is neither taught nor rendered obvious thereby.

SUMMARY OF THE INVENTION

It is therefore one object of the invention to provide a portable misting fan comprising a housing; a fluid reservoir configured to contain a quantity of fluid and including an externally threaded neck on one end; an internally threaded connecting ring configured to threadedly secure to the externally threaded neck so as to releasably fasten the housing and the fluid reservoir together; a battery powered fan motor disposed in the housing; a plurality of fan blades driven by the fan motor; a first switch disposed on the housing for turning on or off the fan motor; a battery powered pump motor disposed in the housing; a pump driven by the pump motor; a fluid outlet port disposed on the pump; a hose having one end secured to the fluid outlet port; an atomizing head mounted on the housing and secured to an other end of the hose; a fluid inlet tube extending out of the pump; a second switch disposed on the housing for turning on or off the pump motor; and a fluid tube having one end secured to an end of the fluid inlet tube and an other end passing through the connecting ring to terminate in the fluid reservoir; wherein a turning on of the first switch activates the fan motor to rotate the fan blades; wherein a subsequent turning on of the second switch activate the pump motor which in turn activates the pump to draw the fluid in the fluid reservoir to the atomizing head via the fluid tube, the fluid inlet tube, the pump, the fluid outlet port, and the hose; wherein the fluid is atomized by the atomizing head to become mist droplets prior to exiting the atomizing head; and wherein the rotating fan blades blows an air stream to mix with the mist droplets.

The above and other objects, features and advantages of the invention will become apparent from the following detailed description taken with the accompanying drawings.

DETAILED DESCRIPTION OF THE INVENTION

Figure 1:
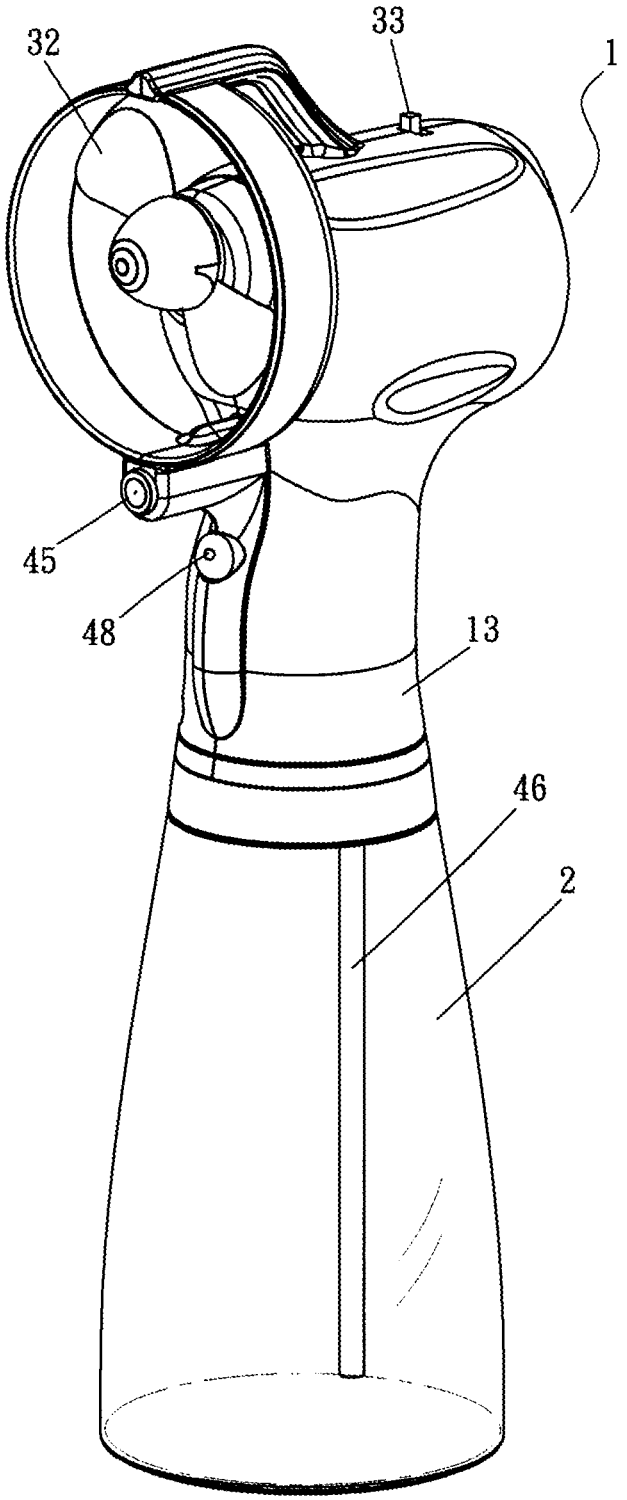
FIG. 1 is a perspective view of a portable misting fan according to the invention.
Figure 2:
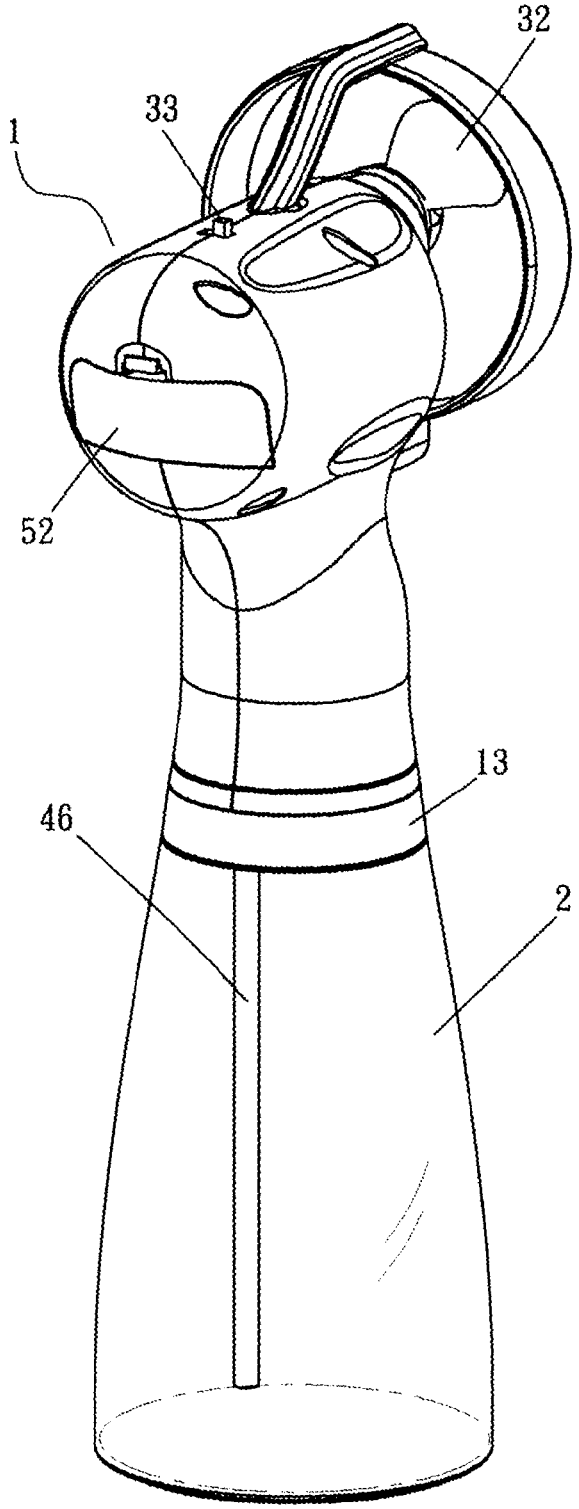
FIG. 2 is another perspective view of the portable misting fan.
Figure 3:
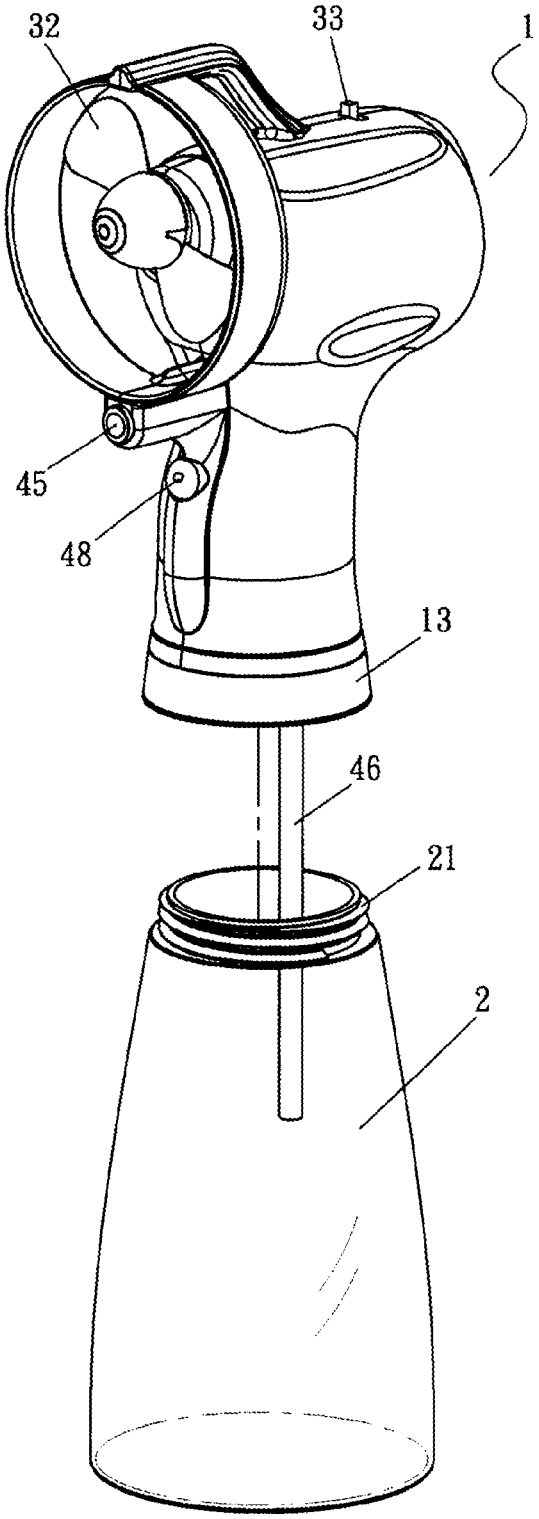
FIG. 3 is an exploded perspective view of the portable misting fan with the fluid reservoir being detached.
Figure 4:
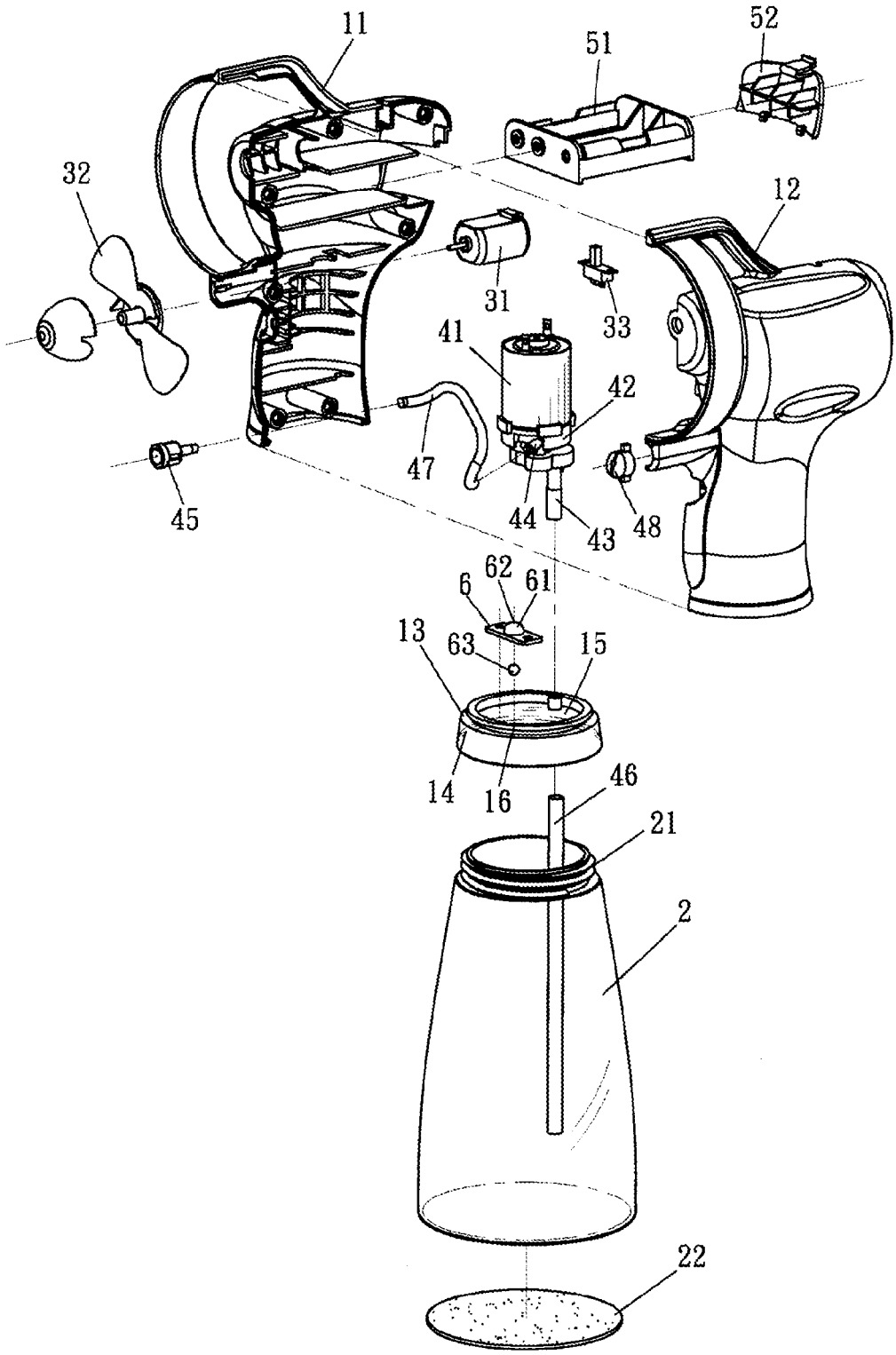
FIG. 4 is an exploded view of the portable misting fan.

Referring to FIGS. 1 to 4, a portable misting fan in accordance with the invention comprises the following components as discussed in detail below.

A housing 1 is provided and a fluid reservoir 2 made of transparent, plastic material is provided. The housing 1 includes a left shell 11, a right shell 12, and a connecting ring 13. The fluid reservoir 2 has an externally threaded neck 21 on a top and a slip resistant pad 22 on an underside. Within the housing 1 there is provided a fan motor 31. Two opposite flexible fan blades 32 are mounted on a driving shaft of the fan motor 31. A fan switch 33 is provided on an outer surface of the housing 1.

Within the housing 1 there are further provided a pump motor 41, a high pressure pump 42 below the pump motor 41, a fluid outlet port 44 on the high pressure pump 42, a hose 47 having one end secured to the fluid outlet port 44, an atomizing head 45 mounted on the other end of the hose 47 and being exposed, and a fluid inlet tube 43 extending downward from the high pressure pump 42. A push button switch 48 is provided on the housing 1. The atomizing head 45 is located between the lower push button switch 48 and the upper fan blades 32.

A battery assembly 51 containing a number of cells is disposed above the fan motor 31. The fan motor 31 and the pump motor 51 are powered by the battery assembly 51. Activation of the fan motor 31 is controlled by the fan switch 33. Activation of the pump motor 41 is controlled by the push button switch 48. A releasable cover 52 is provided to a rear end of the battery compartment 51 for facilitating cells replacement. A fluid tube 46 has one end secured to a bottom end of the fluid inlet tube 43 and a bottom end terminated in the fluid reservoir 2 after passing through the connecting ring 13.

The bottom of the housing 1 is secured to a top of the connecting ring 13. The connecting ring 13 includes internal threads 14 adapted to threadedly secure to the externally threaded neck 21 for fastening the housing 1 and the fluid reservoir 2 together. The connecting ring 13 further includes an internal disc-shaped divider plate 15, and a hole 16 through the divider plate 15. A rectangular valve 6 includes an internally hollowed dome 61 on a top surface, a channel 62 through the dome 61, and a ball 63 provided in the dome 61 and seated on the hole 16. The ball 63 is provided for balancing pressure in a normal operation. Further, the ball 63 can block the channel 62 for stopping fluid flow when the invention is inverted.

In operation, a user may turn on the fan switch 33. Next, the user may turn on the push button switch 48 to activate the pump motor 41 which in turn activates the high pressure pump 42. The high pressure pump 42 sucks fluid in the fluid reservoir 2 through the fluid tube 46. And in turn, the fluid flows to the atomizing head 45 via the fluid inlet tube 43, the high pressure pump 42, the fluid outlet port 44, and hose 47. The fluid is atomized by the atomizing head 45 to become fine mist prior to exiting the atomizing head 45. Further, the fan blades 32 are rotated to blow an air stream which further mixes with the mist droplets so that the user may feel a degree of cool when the fine mist impinge on the skin and clothing.

While the invention has been described in terms of preferred embodiments, those skilled in the art will recognize that the invention can be practiced with modifications within the spirit and scope of the appended claims.

What is claimed is:

1. A portable misting fan comprising:

a housing;

a fluid reservoir configured to contain a quantity of fluid and including an externally threaded neck on one end;

an internally threaded connecting ring configured to threadedly secure to the externally threaded neck so as to releasably fasten the housing and the fluid reservoir together;

a battery powered fan motor disposed in the housing;

a plurality of fan blades driven by the fan motor;

a first switch disposed on the housing for turning on or off the fan motor;

a battery powered pump motor disposed in the housing;

a pump driven by the pump motor;

a fluid outlet port disposed on the pump;

a hose having one end secured to the fluid outlet port;

an atomizing head mounted on the housing and secured to an other end of the hose;

a fluid inlet tube extending out of the pump;

a second switch disposed on the housing for turning on or off the pump motor;

a fluid tube having one end secured to an end of the fluid inlet tube and an other end passing through the connecting ring to terminate in the fluid reservoir; and a divider plate disposed in the connecting ring and including a through hole; and a valve including an internally hollowed dome on an outer surface, a channel disposed through the dome, and a ball disposed in the dome and seated on the through hole; wherein the ball is configured to block the channel for stopping fluid flow when the fluid reservoir is inverted, wherein a turning on of the first switch activates the fan motor to rotate the fan blades; wherein a subsequent turning on of the second switch activate the pump motor which in turn activates the pump to draw the fluid in the fluid reservoir to the atomizing head via the fluid tube, the fluid inlet tube, the pump, the fluid outlet port, and the hose;

wherein the fluid is atomized by the atomizing head to become mist droplets prior to exiting the atomizing head; and wherein the rotating fan blades blows an air stream to mix with the mist droplets.

* * * * *